United States Patent [19]

Rao et al.

[11] Patent Number: 4,495,441

[45] Date of Patent: Jan. 22, 1985

[54] PYROELECTRIC TARGETS AND METHOD OF MANUFACTURE

[75] Inventors: N. Vasanth Rao, Foster, R.I.; Avner Shaulov, Monsey, N.Y.

[73] Assignee: North American Philips Corporation, New York, N.Y.

[21] Appl. No.: 213,432

[22] Filed: Dec. 5, 1980

[51] Int. Cl.[3] ..... H01J 9/20; H01J 29/10

[52] U.S. Cl. ..... 313/388; 445/36; 445/49

[58] Field of Search ..... 313/388; 445/49, 36, 445/35

[56] References Cited

U.S. PATENT DOCUMENTS 4,348,611 9/1982 Ruppel et al. ..... 313/388

FOREIGN PATENT DOCUMENTS 2095035 6/1982 United Kingdom .
302992 11/1971 U.S.S.R. .

OTHER PUBLICATIONS

Lines, M. E., et al. *Principles and Applications of Ferroelectrics and Related Materials*, Clarendon Press (1977) pp. 562, 574–576.

Liu, S. T. et al., "Pyroelectric Detector and Materials," *Proc. of the IEEE* vol. 66, No. 1, Jan. 1978, pp. 14–26.

Singer, B. "Theory and Performance Characteristics of Pyroelectric Imaging Tubes," pp. 12 and 66, *Advances in Image Pickups and Display*, Academic Press, 1977 (edited by B. Kazan).

*Primary Examiner*—Palmer Demeo
*Attorney, Agent, or Firm*—Marc D. Schechter

[57] ABSTRACT

A pyroelectric target made of a pyroelectric material which is anisotropic dielectrically. Electrodes are provided on two plane parallel faces. To raise the pyroelectric figure of merit, the angle between the pyroelectric axis and the normal to the planar faces is greater than substantially 0° but less than 90°. A method of manufacturing such a target includes the step of selecting such an angle and cutting the faces into the material at the selected angle. A pyroelectric vidicon tube incorporating such a pyroelectric target has improved performance. Preferably, the projection of the normal to the planar faces onto a plane perpendicular to the pyroelectric axis is parallel to the axis along which the dielectric constant is lowest.

14 Claims, 6 Drawing Figures

PYROELECTRIC TARGETS AND METHOD OF MANUFACTURE

BACKGROUND OF THE INVENTION

The invention relates to pyroelectric targets for use in pyroelectric vidicon tubes, pyroelectric point detectors, solid state pyroelectric imagers, and other pyroelectric devices. The invention also relates to a method of manufacturing pyroelectric targets and to pyroelectric vidicon tubes having such targets.

In the manufacture of a pyroelectric target from a pyroelectric material (i.e. a material which exhibits spontaneous polarization), the material must be cut to produce two flat, parallel faces. The performance of such a pyroelectric target as an infrared vidicon target depends, at least in part, on the figure of merit, M, of the target. The figure of merit, M, is given by the expression $$M = \frac{p}{\epsilon c},$$

where p is the component of the pyroelectric coefficient of the material in a direction perpendicular to the faces of the target, $\epsilon$ is the dielectric constant (permittivity) of the material in a direction perpendicular to the faces of the target, and c is the specific heat of the material per unit volume. The pyroelectric coefficient is the rate of change of the spontaneous polarization of the material with temperature.

In selecting pyroelectric materials for use as vidicon targets, it is desirable to choose a material having as high a figure of merit as possible in order to maximize the signal produced from the detected infrared radiation.

For infrared point detectors, the maximum responsivity bandwidth product (and also the open circuit voltage responsivity) are proportional to $$\frac{p}{\epsilon c},$$

where p, c, and $\epsilon$ are the same quantities discussed above. For the same reason discussed above, it is desirable to choose a pyroelectric material for infrared point detectors having as high a figure of merit as possible.

Having selected a pyroelectric material for use as a target, it is apparent that a high performance can be obtained by maximizing the component of the pyroelectric coefficient which is perpendicular to the faces of the target. The component of the pyroelectric coefficient, p, is thus maximized by cutting the target with its ferroelectric polar axis (pyroelectric axis) perpendicular to the polished faces of the crystal. This pyroelectric axis is defined as being along the direction of spontaneous polarization. For pyroelectric vidicons, such a target and such a method of manufacturing this target is taught in *Advances in Image Pickup and Display, Volume* 3, "Theory and Performance Characteristics of Pyroelectric Imaging Tubes" by B. Singer, Academic Press, 1977 (edited by B. Kazan). It is similarly known to produce infrared point detectors by electroding the target material normal to the polar (pyroelectric) axis. Such point detectors are known from *Principals and Applications of Ferroelectrics and Related Materials*, M. E. Lines et al, Clarendon Press, Oxford, 1977 (page 562). Providing a high performance by maximizing the component of the pyroelectric coefficient is also taught in an article entitled "Pyroelectric Detectors and Materials" (Proceedings of IEEE, Volume 66, No. 1, pages 14–26, January 1978), by S. T. Liu et al, in which the pyroelectric material is provided with electroded surfaces normal to the polarization vector. (See, the first page of this article.)

In the known pyroelectric targets and the known methods of manufacturing such targets, although the component of the pyroelectric coefficient normal to the electroded faces of the target is maximized, the figure of merit or the maximum responsivity bandwidth product is limited, in general, by a high permittivity along the pyroelectric axis. As a result, although high performance is obtained, the performance is not generally as high as desirable.

SUMMARY OF THE INVENTION

It is an object of the invention to provide pyroelectric targets with improved performance (e.g. improved figures of merit or improved maximum responsitivity bandwidth products).

It is a further object of the invention to provide pyroelectric targets having the maximum performance attainable for the particular material used at the chosen temperature of operation.

Yet a further object of the invention is to provide a method of manufacturing pyroelectric targets having improved performance.

Still a further object of the invention is to provide a method of manufacturing pyroelectric targets having the maximum performance attainable for the pyroelectric material used at the chosen operating temperature.

According to the present invention, a pyroelectric target is made of a pyroelectric material which is anisotropic dielectrically. The target has two faces which are substantially planar and which are substantially parallel to each other. The planar faces are provided with electrodes. The angle between the pyroelectric axis and the normal to the planar faces is greater than substantially 0° but less than 90°. In other words, the pyroelectric axis is not substantially normal to the electroded faces of the target.

A method of manufacturing a pyroelectric target includes the step of providing a pyroelectric material which is anisotropic dielectrically. Next, two substantially parallel, substantially planar faces are cut into the material and these faces are provided with electrodes. According to the present invention, these faces are cut such that the angle between the pyroelectric axis of the material and a normal to the planar faces is greater than substantially 0° but less than 90°.

A pyroelectric vidicon tube according to the present invention includes a pyroelectric target having faces such that the angle between a pyroelectric axis and a normal to the planar faces is greater than substantially 0° but less than 90°.

In a preferred embodiment of the invention, the pyroelectric target is made of a material whose pyroelectric axis is parallel to one of the three principal axes of the dielectric tensor of the pyroelectric material.

According to another aspect of the present invention, the angle between the pyroelectric axis and the normal to the planar faces is substantially equal to $$\theta_{opt} = \tan^{-1}\left[\left(\frac{\epsilon_2}{\epsilon_m} - 2\right)^{\frac{1}{2}}\right],$$

where $\epsilon_2$ is the dielectric constant along the principal axis parallel to the pyroelectric axis and $\epsilon_m$ is the lesser of the dielectric constants along the other two principal axes of the crystal, and $\epsilon_2$ is greater than $2\epsilon_m$.

Preferably, the projection of the normal to the planar faces onto a plane perpendicular to the pyroelectric axis is parallel to the axis along which the dielectric constant is $\epsilon_m$.

In still a further embodiment of the invention, the pyroelectric material is deuterated triglycine fluoroberyllate (DTGFB). The known figure of merit, for a pyroelectric vidicon target made of DTGFB, is one of the highest for all known pyroelectric materials. According to the invention even higher figures of merit can be achieved with DTGFB. Preferably, the angle between the pyroelectric axis and the normal to the planar faces is greater than 25° and less than 87°.

DESCRIPTION OF THE PREFERRED EMBODIMENTS

In order to maximize the figure of merit, M, of a pyroelectric vidicon target, given by the expression $$M = \frac{p}{\epsilon c},$$

where p equals the component of the pyroelectric coefficient in a direction normal to the electroded faces of the target, c equals the volume specific heat, and $\epsilon$ equals the dielectric constant (permittivity) perpendicular to the electroded, planar faces of the crystal, it is desirable to maximize the component of the pyroelectric coefficient and to minimize the permittivity. As discussed above, in order to maximize the component of the pyroelectric coefficient, the planar faces should be cut perpendicular to the pyroelectric axis.

In crystals which are anisotropic dielectrically, the permittivity is different along at least two of the three mutually orthogonal prinicipal axes of the crystal. Accordingly, in order to minimize the permittivity, the crystal faces should be cut perpendicular to the principal axis in whose direction the permittivity is smallest. In general, this direction is not along the pyroelectric axis. As a result, the maximum figure of merit will not necessarily occur at a cut which maximizes the component of the pyroelectric coefficient or at a cut which minimizes the permittivity.

Before one attempts to determine the optimum cut of a pyroelectric material in order to produce a maximum figure of merit, one must make an initial assumption that the pyroelectric material is anisotropic dielectrically. If the material is isotropic dielectrically, the maximum figure of merit is trivially obtained with a cut perpendicular to the pyroelectric axis, since this maximizes p and since the permittivity does not depend on the direction of the cut.

Figure 1:
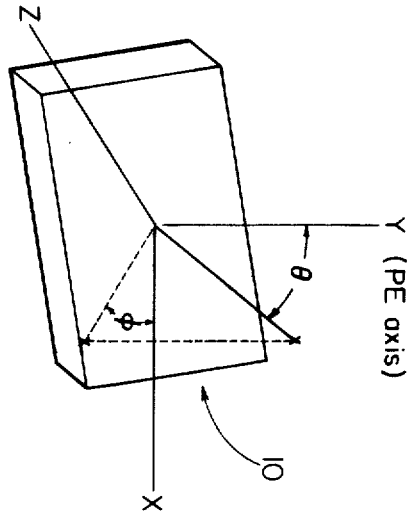
FIG. 1 is a perspective view of a coordinate system whose axes lie along the principal axes of a pyroelectric material. The pyroelectric axis of the material is parallel to the y principal axis.

For the purpose of mathematically determining the cut of the pyroelectric material which optimizes $p/\epsilon$ c, FIG. 1 shows mutually orthogonal axes x, y, and z which are the principal axes of the crystal. In FIG. 1, the crystal is represented by pyroelectric target 10. For this analysis it will be further assumed that the pyroelectric axis coincides with the y axis. It is not a necessary requirement of the invention that the pyroelectric axis coincide with a principal axis. However, this assumption holds true for many pyroelectric materials and it substantially simplifies the mathematics outlined below.

The pyroelectric axis coincides with a principal axis, for example, in crystals having monoclinic 2 crystal structure, such as triglycine sulfate (TGS), and deuterated triglycine fluoroberyllate (DTGFB); orthorhombic 2 mm structure, such as lithium ammonium sulfate; tetragonal 4 mm structure, such as barium titanate; trigonal 3 m structure, such as lithium tantalate; and hexagonal 6 structure such as lithium potassium sulfate. The foregoing list of crystal structures and materials is not meant to be exhaustive as there are additional classes of crystal structures in which the pyroelectric axis coincides with a principal axis and there are additional pyroelectric materials also satisfying this condition.

Referring again to FIG. 1, the pyroelectric coeffient and the permittivity measured along a direction ( $\theta$, $\phi$) are given by the expressions $$p(\theta) = |P|\cos\theta, \text{ and}$$

$$\epsilon(\theta, \phi) = \epsilon_1\sin^2\theta\cos^2\phi + \epsilon_3\sin^2\theta\sin^2\phi + \epsilon_2\cos^2\theta,$$

where P and $\epsilon_2$ are the pyroelectric coefficient and permittivity, respectively, measured along the pyroelectric axis (y axis), and $\epsilon_1$ and $\epsilon_3$ are the magnitudes of the permittivities measured along the x and z axes, respectively. The direction ($\theta$, $\phi$) is meant to signify the direction of a vector having its origin at the origin, of the x, y, z coordinate system, wherein $\theta$ is the angle between the y-axis and the vector, and $\phi$ is the angle between the x-axis and the projection of the vector onto the x, z plane.

As is well known, the permittivity is defined as the electric displacement field, D, divided by the electric field, E. The displacement field, D, need not necessarily be in the same direction as the electric field, E. In such a case, the permittivity, $\epsilon(\theta, \phi)$, is equal to the magnitude of the electric displacement field component in the direction of the electric field divided by the magnitude of the electric field. Thus, $$\epsilon(\theta,\phi) = \frac{D \cdot E}{E \cdot E},$$

where E is in the direction ($\theta$, $\phi$).

Accordingly, the figure of merit, M, for a pyroelectric target having planar faces perpendicular to the direction ($\theta$, $\phi$), is given by the expression $$M(\theta,\phi) = \frac{|P|\cos\theta/c}{\epsilon_1\sin^2\theta\cos^2\phi + \epsilon_3\sin^2\theta\sin^2\phi + \epsilon_2\cos^2\theta},$$

and the gain, G, in the figure of merit is defined as $$G(\theta,\phi) = \frac{M(\theta,\phi)}{M(\theta = 0)} = \frac{M(\theta,\phi)}{p/\epsilon_2 c} = \frac{\epsilon_2\cos\theta}{\epsilon_1\sin^2\theta\cos^2\phi + \epsilon_3\sin^2\theta\sin^2\phi + \epsilon_2\cos^2\theta}.$$

The magnitude of the volume specific heat, c. is independent of the direction ($\theta$, $\phi$).

Since the component of the pyroelectric coefficient is not dependent upon the angle $\phi$, it is immediately apparent that $\phi opt = 0°$ if $\epsilon_1 < \epsilon_3$, or $\phi opt = 90°$ if $\epsilon_3 < \epsilon_1$.

In other words, the figure of merit is optimized, with respect to $\phi$, when the projection of the normal to the planar faces onto a plane perpendicular to the pyroelectric axis is parallel to the axis along which the dielectric constant is the lower of $\epsilon_1$ or $\epsilon_3$.

Thus, the expressions for M and G become $$M(\theta,\phi) = \frac{|P|\cos\theta}{\epsilon_m\sin^2\theta + \epsilon_2\cos^2\theta}$$

$$G(\theta,\phi) = \frac{\epsilon_2\cos\theta}{\epsilon_m\sin^2\theta + \epsilon_2\cos^2\theta}$$

where $\epsilon_m$ is the smaller one among $\epsilon_1$ and $\epsilon_3$.

By differentiating either of these expressions with respect to $\theta$ and setting the derivatives equal to zero, one arrives at an expression for the optimum value of the angle between the pyroelectric axis and the normal to the crystal faces:

$$\theta_{opt} = \tan^{-1}\left[\left(\frac{\epsilon_2}{\epsilon_m} - 2\right)^{\frac{1}{2}}\right],$$

where $\epsilon_2$ is greater than 2 $\epsilon$m. If $\epsilon 2 < 2\epsilon m$, $\theta_{opt} = 0°$.

By substituting the expression for $\theta_{opt}$ into the expression for G($\theta$, $\phi$), one obtains $$G_{max} = \frac{\epsilon_2}{[4\,\epsilon_m(\epsilon_2 - \epsilon_m)]^{\frac{1}{2}}}$$

EXAMPLE

DTGFB is a pyroelectric material which is anisotropic dielectrically. Once the components of the permittivity tensor are measured in any coordinate system, the principal axes of DTGFB, or any other dielectric material, can be found by one with ordinary skill in the art by reference to the book entitled *The Physical Properties of Crystals*, by J. F. Nye (Clarendon Press, Oxford, 1957). Below the transition point (Curie temperature, $T_c = 73°$ C.) DTGFB belongs to the point group 2 of the monoclinic symmetry crystal class. The two-fold axis (b-axis) is the pyroelectric axis and is a principal axis of the permittivity tensor, a second rank tensor.

After the angle of the cut is determined, the pyroelectric material can be cut by using a string saw, by cleavage, or by another suitable method. (See, e.g. *Advances in Image Pick-up and Display, Volume* 3, supra.)

Figure 2:
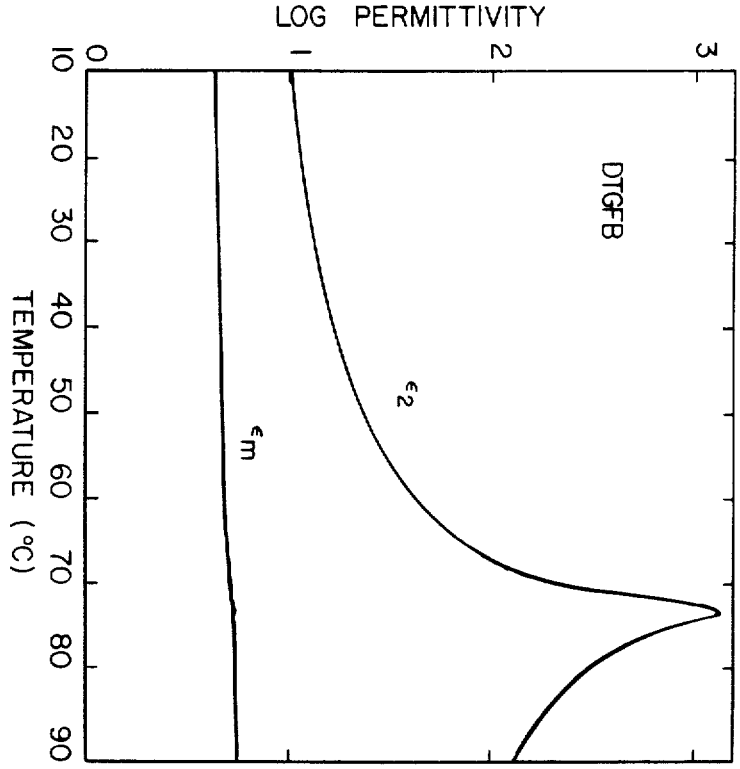
FIG. 2 is a graph plotting the log of the permittivity, $\epsilon_2$, along the pyroelectric axis of DTGFB versus the temperature, and plotting the log of the permittivity $\epsilon_m$ along one of the other principal axes (whichever axis has the lower permittivity) of DTGFB versus the temperature. The points plotted in FIG. 2 are from experimental data.

The temperature dependencies of the permittivity, $\epsilon_2$, along the pyroelectric axis and the lower of the permittivities, $\epsilon_m$, along the remaining principal axes, shown in FIG. 2, reveal that the ratio $$\frac{\epsilon_2}{\epsilon_m}$$

increases dramatically as the transition point is approached.

Figure 3:
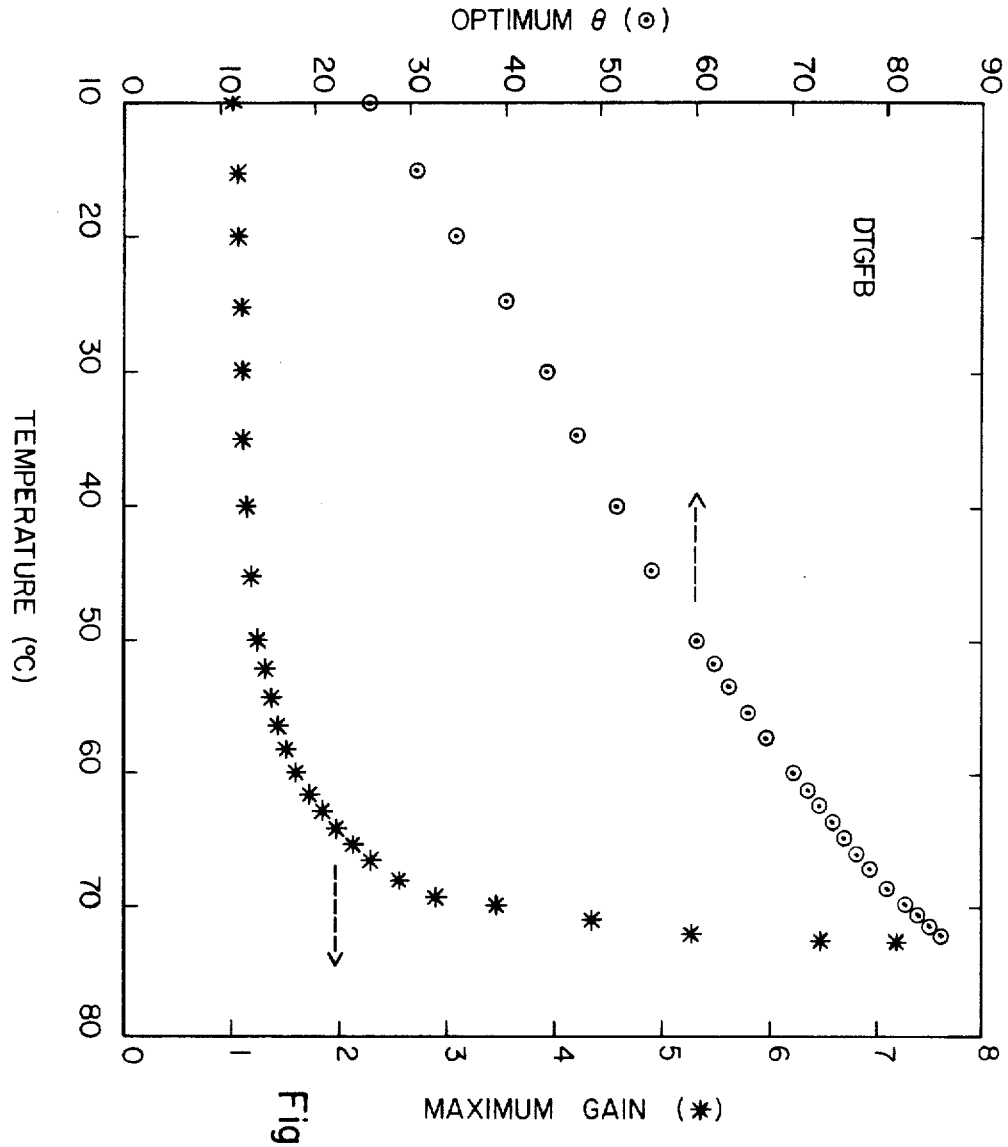
FIG. 3 is a graph plotting the calculated optimum angle between the pyroelectric axis and a normal to the planar faces versus the temperature, and plotting the calculated maximum gain in the figure of merit at the optimum angle as compared to an angle of 0°, versus the temperature. Both of these plots are for DTGFB.

As a result of the behavior of the permittivities of DTGFB with increasing temperature, the optimum angle between the pyroelectric axis and the normal to the crystal faces increases with temperature as shown in FIG. 3. Similarly, the maximum gain, G, in the figure of merit increases with the temperature.

Figure 4:
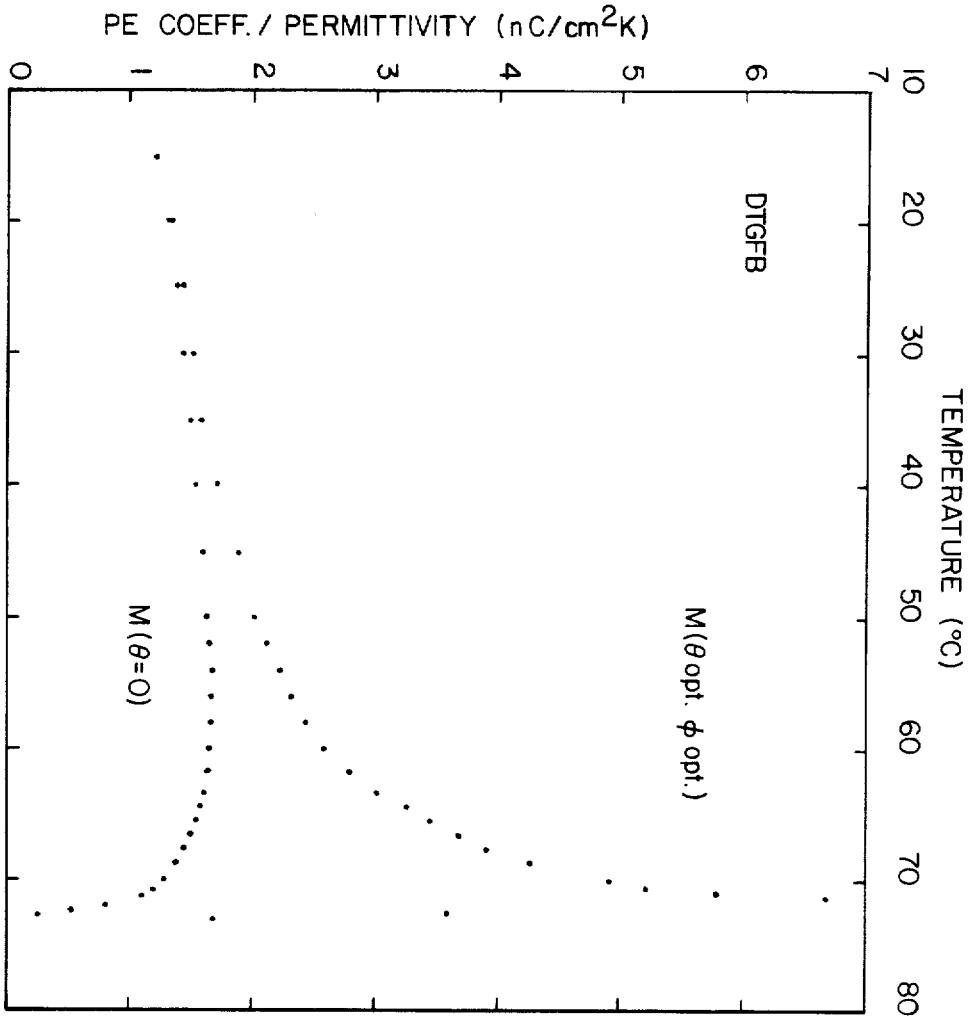
FIG. 4 is a graph in which $p/\epsilon$ is plotted versus the temperature where the angle between the pyroelectric axis and the normal to the planar faces is optimum in the first plot and is 0° in the second plot. Both of these plots are for DTGFB. The points plotted for the optimum angle were calculated and the points plotted for 0=0 are from experimental data.

FIG. 4 shows the temperature dependencies of p/$\epsilon$ versus temperature for the optimum cuts at each temperature and for cuts perpendicular to the pyroelectric axis at each temperature. From this it can be seen that the ratio p/$\epsilon$ will be largest at approximately 71.5° C. and its value is approximately 4 times the maximum value attainable with a cut perpendicular to the pyroelectric axis.

Figure 5:
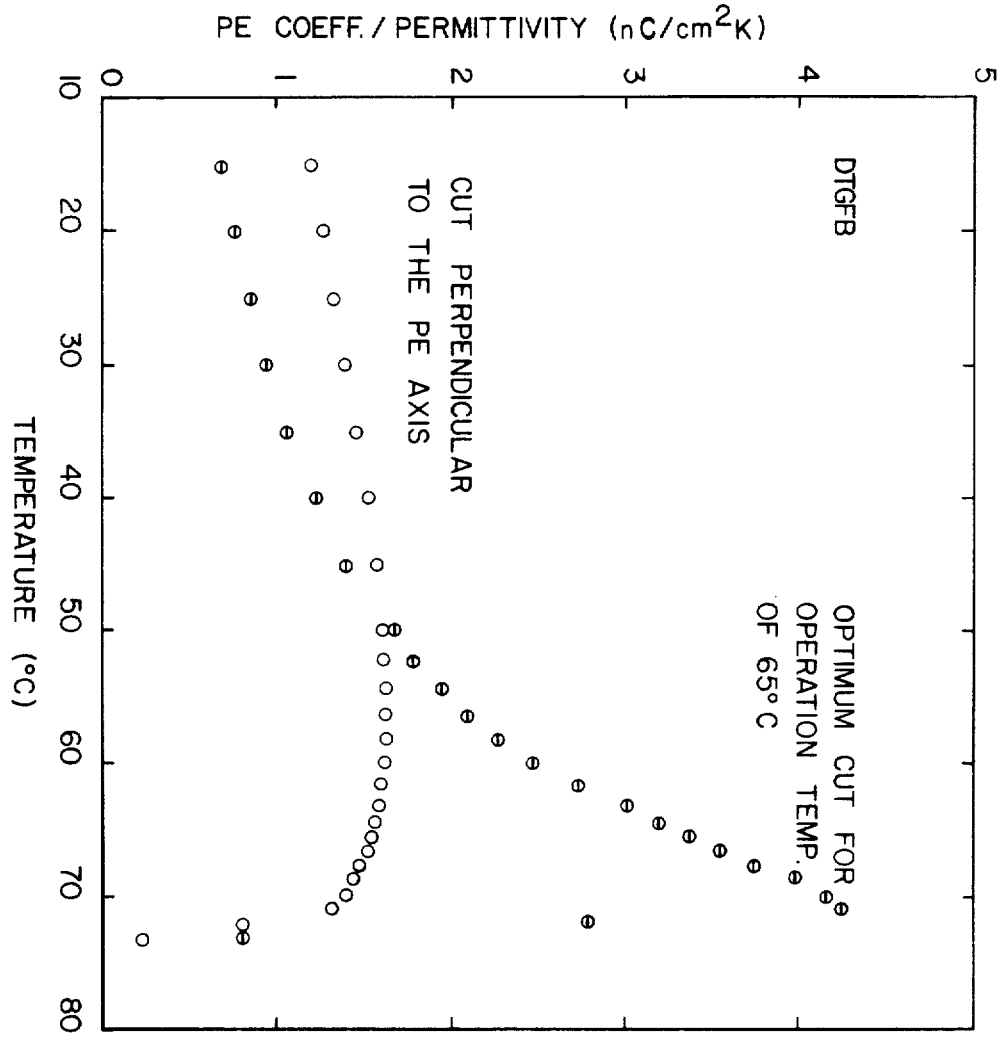
FIG. 5 is a graph in which $p/\epsilon$ is plotted against the temperature for cuts in which the angles between the pyroelectric axes and normals to the planar faces are 74.3° and 0°, respectively. Both of these plots are for DTGFB. The points plotted for the 74.3° cut were calculated and the points plotted for the 0° cut are from experimental data.

In FIG. 5, p/$\epsilon$ is plotted against the temperature for the optimum cut for operation at a temperature of 65° C. and for a cut perpendicular to the pyroelectric axis. At 65° C., the optimum angle between the pyroelectric axis and the normal to the planar faces is approximately 74.3°. Such a cut improves the figure of merit by a factor of 2 compared to the maximum value of the figure of merit when the crystal is cut perpendicular to the pyroelectric axis.

Also, apparent from FIG. 5 is that the p/$\epsilon$ versus temperature curve for the 74.3° cut has a relatively steep slope near the Curie point. As a result, the optimum temperature of operation of a pyroelectric target according to the present invention must be selected by taking ito account at least two competing factors: a desired high figure of merit and a desired low temperature dependency of the figure of merit (i.e. the height of the peak versus the width of the peak).

Figure 6:
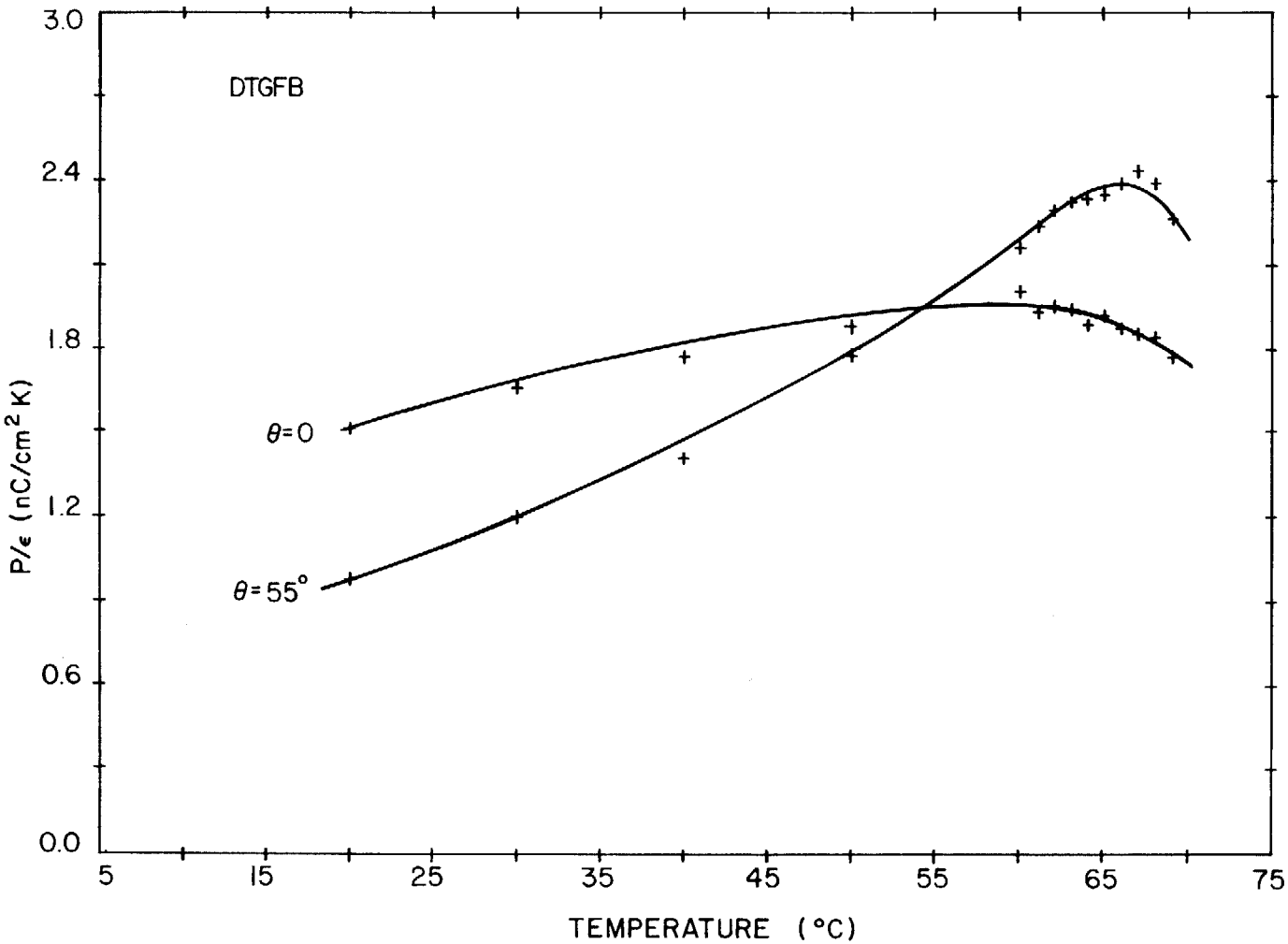
FIG. 6 is a graph in which $p/\epsilon$ is plotted against the temperature for cuts in which the angles between faces are 55° and 0°, respectively. Both of these plots are for DTGPB and the plotted points are all experimental.

FIG. 6 shows the experimentally measured value of $p/\epsilon$ for $\theta=55°$. It should be noted that while the target was cut at $\theta=55°$, the projection of the normal to the planar faces onto a plane perpendicular to the pyroelectric axis was parallel to the axis along which the dielectric constant was the greater of $\epsilon_1$ and $\epsilon_2$. Nevertheless, at temperatures above approximately 55° C., there is a gain in the figure of merit with this cut.

Incorporating the target cut at $\theta=55°$ into a vidicon tube resulted in a 15% improvement in sensitivity as compared to tubes having targets cut at $\theta=0°$.

Although the invention has been described with reference to the preferred embodiments, above, one with ordinary skill in this art would recognize that the invention is not limited to these embodiments. For example, while the figure of merit for pyroelectric point detectors will not be increased by cutting the target according to the invention, the maximum responsivity bandwidth product of such detectors is increased by the invention. It is also intended that all variations and modifications of the described embodiments fall within the scope of the appended claims. Furthermore, although a theoretical explanation for the increase in the figure of merit has been advanced and shows good agreement with experimental data, the scope of the invention is not limited by this theory.

I claim:

1. A pyroelectric target comprising a pyroelectric material having a pyroelectric axis, said material being anisotropic dielectrically and having two faces which are substantially planar and which are substantially parallel to each other, said faces being provided with electrodes, characterized in that the angle between the pyroelectric axis and a normal to the planar faces is greater than substantially 0° but less than 90°.

2. A pyroelectric target as claimed in claim 1, characterized in that the pyroelectric material is substantially a single crystal with three principal axes, and the pyroelectric axis is parallel to a principal axis of the crystal.

3. A pyroelectric target as claimed in claim 2, characterized in that the pyroelectric material is DTGFB and the angle between the pyroelectric axis and the normal to the planar faces is greater than 25°.

4. A pyroelectric target as claimed in claim 3, characterized in that the angle between the pyroelectric axis and the normal to the planar faces is greater than 50° and less than 87°.

5. A pyroelectric target as claimed in claim 2 or 4, characterized in that the angle $\theta$ between the pyroelectric axis and the normal to the planar faces is substantially equal to $$\theta_{opt} = \tan^{-1}\left[\left(\frac{\epsilon_2}{\epsilon_m} - 2\right)^{\frac{1}{2}}\right],$$

where $\epsilon_2$ is the dielectric constant along the principal axis parallel to the pyroelectric axis, $\epsilon_m$ is the lesser of the dielectric constants along the other two principal axes of the crystal, and $\epsilon_2$ is greater than $2\epsilon_m$, at a chosen operating temperature.

6. A pyroelectric target as claimed in claim 5, characterized in that the projection of the normal to the planar faces onto a plane perpendicular to the pyroelectric axis is parallel to the axis along which the dielectric constant is $\epsilon_m$.

7. A method of manufacturing a pyroelectric target comprising the steps of:

providing a pyroelectric material having a pyroelectric axis, said material being anisotropic dielectrically;

forming two substantially parallel, substantially planar faces in the material; and providing the planar faces with electrodes;

characterized in that the step of forming comprises forming the faces such that the angle between the pyroelectric axis and a normal to the planar faces is greater than substantially 0° but less than 90°.

8. A method of manufacturing a pyroelectric target as claimed in claim 7, characterized in that the step of forming two faces comprises cutting two substantially parallel, substantially planar faces into the pyroelectric material.

9. A method of manufacturing a pyroelectric target as claimed in claim 8, characterized in that the pyroelectric material is substantially a single crystal with three principal axes, and the pyroelectric axis is parallel to a principal axis of the crystal.

10. A method of manufacturing a pyroelectric target as claimed in claim 9, characterized in that the pyroelectric material is DTGFB and the angle between the pyroelectric axis and the normal to the planar faces is greater than 25°.

11. A method of manufacturing a pyroelectric target as claimed in claim 10, characterized in that the angle between the pyroelectric axis and the normal to the planar faces is greater than 50° and less than 87°.

12. A method of manufacturing a pyroelectric target as claimed in claim 9 or 11, characterized in that the angle $\theta$ between the pyroelectric axis and the normal to the planar faces is substantially equal to $$\theta_{opt} = \tan^{-1}\left[\left(\frac{\epsilon_2}{\epsilon_m} - 2\right)^{\frac{1}{2}}\right],$$

where $\epsilon_2$ is the dielectric constant along the principal axis parallel to the pyroelectric axis, $\epsilon_m$ is the lesser of the dielectric constants along the other two principal axes of the crystal, and $\epsilon_2$ is greater than $2\,\epsilon_m$ at a chosen operating temperature.

13. A method of manufacturing a pyroelectric target as claimed in claim 12, characterized in that the projection of the normal to the planar faces onto a plane perpendicular to the pyroelectric axis is parallel to the axis along which the dielectric constant is $\epsilon_m$.

14. A pyroelectric target comprising a pyroelectric material having a pyroelectric axis, said material being anisotropic dielectrically and having two faces which are substantially planar and which are substantially parallel to each other, said faces being provided with electrodes, characterized in that the angle between the pyroelectric axis and a normal to the planar faces is greater than substantially 0° but less 90° and is selected to provide a figure of merit higher than that where the angle is 0°.

* * * * *